US005561859A

United States Patent [19]

Fischer

[11] Patent Number: 5,561,859

[45] Date of Patent: Oct. 8, 1996

[54] LEG WARMER AND TOTE BAG ARTICLE

[76] Inventor: Jay R. Fischer, 309 Roscommon Dr., Bristol, Tenn. 37620

[21] Appl. No.: 379,279

[22] Filed: Jan. 27, 1995

Related U.S. Application Data

[63] Continuation-in-part of Ser. No. 176,208, Jan. 3, 1994, abandoned.

[51] Int. Cl.[6] ..... A41D 1/00

[52] U.S. Cl. ..... 2/69.5; 383/4

[58] Field of Search ..... 2/69.5, 69, 94, 2/239; 36/7.1 R, 9 R, 9 A; 383/4, 110; 190/13 F

[56] References Cited

U.S. PATENT DOCUMENTS

| | | | |
|---|---|---|---|
| 1,608,188 | 11/1926 | Skoler | 36/7.1 R |
| 1,686,586 | 10/1928 | Wendemuth | 36/7.1 R |
| 1,746,459 | 2/1930 | Brady | 36/7.1 R |

FOREIGN PATENT DOCUMENTS

| | | | |
|---|---|---|---|
| 1222493 | 6/1960 | France | 2/69 |

*Primary Examiner*—C. D. Crowder
*Assistant Examiner*—Gloria Hale

[57] ABSTRACT

A multipurpose protective article having both body warming and item toting capacities, and having a front, a back, opposite sides, and a base, all of which are interconnected to provide a generally bag-shaped body open at its top and providing a pocket, the body being constructed of flexible thermal material, a rim on the body extending around the top thereof to provide a closeable opening into the pocket which is configured to have a foot receiving portion and a leg receiving portion for containing respectively the feet and legs of a user or to contain various items, the body further having one or more carrying straps affixed thereto for hand, arm or shoulder supporting of the article, and a closure devices on the rim for either partially or completely closing the opening and allowing the rim, selectively, to snugly surround the legs or to enclose the items within the pocket.

20 Claims, 3 Drawing Sheets

PRIOR ART

LEG WARMER AND TOTE BAG ARTICLE

FIELD OF THE INVENTION

This application is a continuation-in-part of applicants patent application Ser. No. 08/176,208, filed Jan. 3, 1994 now abandoned, and the invention concerns a multipurpose transportable bag to be used as a lightweight pack or as a foot and leg warmer for enjoying outdoor activities during cold weather.

BACKGROUND OF THE INVENTION

Many thermally protective types of garment devices including robes, bags, wraps, quilts or other such thermally equipped articles have been devised for the purpose of protecting the feet and legs of persons, particularly sports spectators, from cold weather such as during late fall football games or other outdoor activities. The more thermally protective of these prior devices are quite bulky and often of complex construction which renders them expensive and difficult to use, transport and to take care of. The singular utility of these articles in protecting against the weather, the ineffectiveness thereof in providing a draftproof pocket for protecting the feet and lower legs, combined with the bulkiness and deteriorability of them, provides the user with less than optimum inspiration to use such devices, particularly when it has to be transported over substantial distance to the outdoor event. Such prior devices are shown, for example, in the following U.S. Pat. Nos.: 1,608,188; 1,686,588; 3,597,764; 3,798,676; 2,146,400; 2,242,130; 1,915,044; 4,932,077; 4,534,065; 2,705,325; 2,459,352; 2,433,626; and 2,230,689.

Objects of the present invention therefore, are: to provide enhanced utility thermal garment, article or device which is useful in protecting the feet and legs of spectators, side-lined participants, or others from the cold at outdoor events, and which is also useful as a tote bag; to provide such enhanced utility in an economical manner; and to provide such article which is safer and easier to use and take care of.

These and other objects hereinafter appearing have been attained in accordance with the present invention which is defined in its broad embodiment as a multipurpose protective article having both body warming and item toting capacities, said article comprising front means, back means, opposite side means, and base means, all of which are sealingly interconnected to provide a generally bag-shaped body means normally open at its top and providing pocket means within said body means, said body means being constructed of flexible thermal material and having flexible rim means extending around the top thereof to provide a substantially completely and selectively closeable opening for entry of a users feet or items into said pocket means, said rim means further being easily enfoldable, snugly around one or Two legs of the user, said pocket means being sufficiently large to easily accommodate the users feet and legs at least up to about adjacent the knee and to readily provide for sitting and standing activity without restricting movement of the feet or lower legs which might otherwise cause stumbling or falling of the user, said body means further having carrying means affixed to the exterior thereof for hand, arm or shoulder supporting of said article, and closure means on said rim means and extending along a desired length thereof for either partially or completely closing said opening and allowing said rim means, selectively, to snugly surround said legs or leg or to enclose said items within said pocket means, said partial or complete closing bringing opposed portions of said rim means into substantial weather-sealing contact, said closure means extending to a desired extent along the length of said rim means and being adapted for holding said opposing portions of said rim means together in said weather-sealing contact to maintain a snug fit of said rim means around said legs or leg to provide and maintain a substantially dead-air space in said pocket means to enhance the body heat trapping and containment efficiency of said article.

In certain preferred embodiments:

(a) the article is constructed of sufficiently rigid material to allow the article to freely stand on its base means with said rim means elevated above said base means substantially the length of a human leg;

(b) the closure means is selected from the group consisting of VELCRO (hook and loop fastener) segments spaced along said rim means, VELCRO strips extending substantially the full length of said rim means, or snap fastener means spaced along said rim means;

(c) the flexible thermal material comprises spaced inner and outer containment layers and thermal insulating material supported therebetween;

(d) the base means is substantially flat and constructed of substantially rigid material and said outer containment layer is sufficiently rigid to readily support said article in an upright, free-standing posture on said base means;

(e) the carrying means comprises back-pack type strap means adapted to extend outwardly from said body means and loop over both shoulders of the user;

(f) the exterior of said base means is constructed of waterproof, semi-rigid material;

(g) the exterior portion of said body means is constructed of substantially waterproof material; and (h) said body means is dimensioned to provide a foot containing area of said pocket means with a front to back length of from about 6 to about 15 inches, a side to side width of from about 11 to about 18 inches, and wherein the height of said pocket means is from about 12 to about 24 inches such as to afford a number of sizes to accommodate the feet and lower legs of children and adults.

BRIEF DESCRIPTION OF THE DRAWINGS

The invention will be further understood from the following drawing and description of preferred embodiments of the invention, wherein.

DETAILED DESCRIPTION OF PREFERRED EMBODIMENTS OF THE INVENTION

Figure 1:
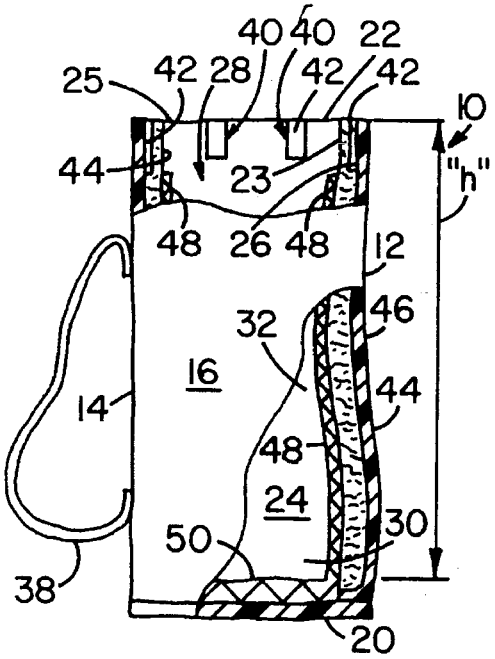
FIG. 1 is a side view of the present article, partially in cross-section, showing one design embodiment.

Referring to the drawing and with reference to the claims hereof, the present multipurpose protective article generally designated 10 having both body warming and item toting capacities comprises a front wall means 12, a back wall means 14, opposite side wall means 16, 18, and base means 20, all of which are interconnected to provide a generally bag-shaped body means open at its top 22 and providing pocket means 24, said body being constructed of flexible thermal material, rim means 26 on said body means extending around the top thereof to provide a closeable opening 28 into said pocket means, said pocket means being configured to have a foot receiving portion 30 and a leg receiving portion 32 adapted to contain respectively the feet 34 and legs 36 of a user or to contain various items, said body means further having carrying means 38 such as back-pack type straps affixed to the exterior thereof for hand, arm or shoulder supporting of said article, and closure means 40 on said rim means for either partially or completely closing said opening and allowing said rim means, selectively, to snugly surround said legs or to enclose said items within said pocket means.

Figure 3:
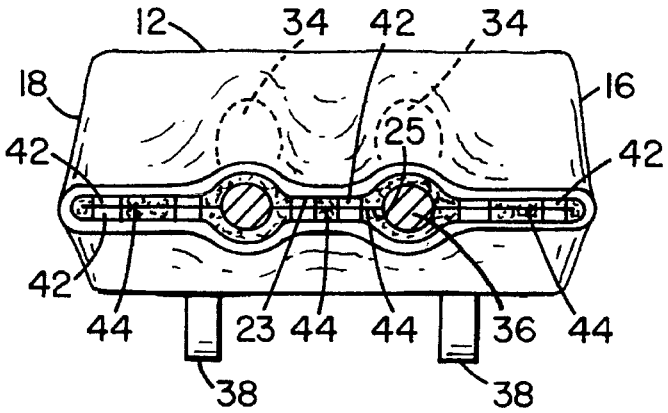
FIG. 3 is a top elevational view of the article showing the rim means snugly collapsed around the users legs.
Figure 8:
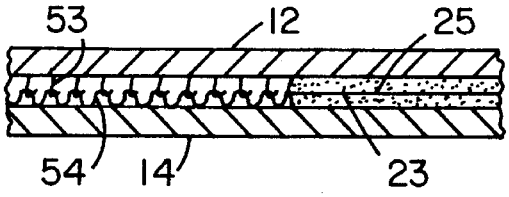
FIG. 8–14 are cross-sectional views of top portions of the body means showing the various preferred closure means, some shown enlarged for clarity, which can be employed for snugging the opposed sides of the rim means of the article around a users legs, or for simply weather-sealing the entire top opening of the body for protecting various items carried within the pocket means against the weather.
Figure 12:
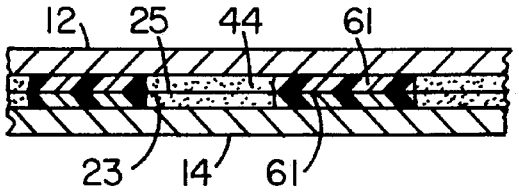
Figure 9:
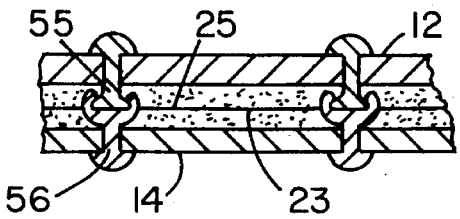
Figure 13:
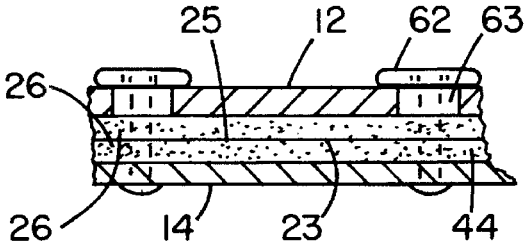
Figure 10:
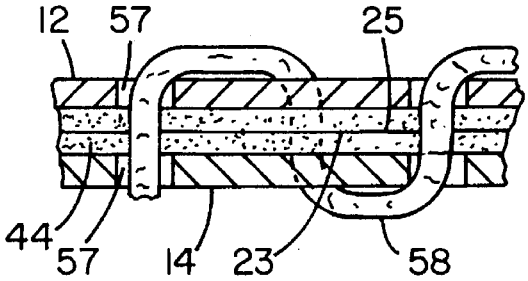
Figure 14:
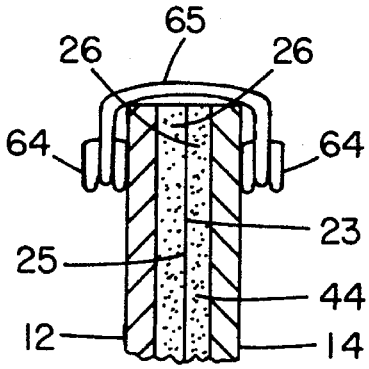
Figure 11:
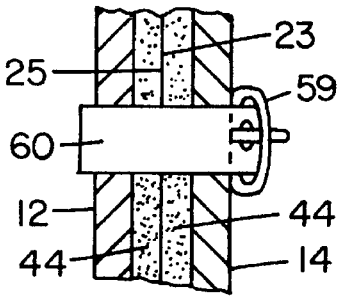

The top opening of the body means is closeable along the top edges or rim means 26 thereof by closure means, preferably selected from the group consisting of (a) a plurality of hooks 53 and cooperating loops 54, FIG. 8, (b) a plurality of cooperating snap fastener components 55, 56, FIG. 9, (c) a plurality of eyelets 57 and at least one tie cord means 58 therefor, FIG. 10, (d) a plurality of cooperating buckle means 59 and strap means 60, FIG. 11, (e) one pair or a plurality of pairs of cooperating adhesive components 61, FIG. 12, (f) a plurality of cooperating buttons 62 and button holes 63, FIG. 13, and (g) a plurality of boot type hooks 64 and at least one tie cord or lace 65 therefor, FIG. 14, to weather-seal the feet and lower legs in a draftproof environment or to weather-seal various items in the pocket means. This closing of the opening 22 is done preferably by bringing the opposed inner sides 23 and 25 of the rim means together. In the embodiment illustrated, the closure means comprises a number of VELCRO hook and loop segments 42 strategically affixed to rim means 26 such that when the rim means is collapsed around the legs as shown in FIG. 3, the VELCRO segments affix to each other and preferably lightly compress the insulating means 44 of the article snugly against and around the legs. The body means preferably is dimensioned to provide a foot containing area for the pocket means of a front to back length "L" of from about 6 to about 15 inches, a side to side width "W" of from about 11 to about 18 inches, and a height "h" of from about 12 to about 24 inches.

Figure 6:
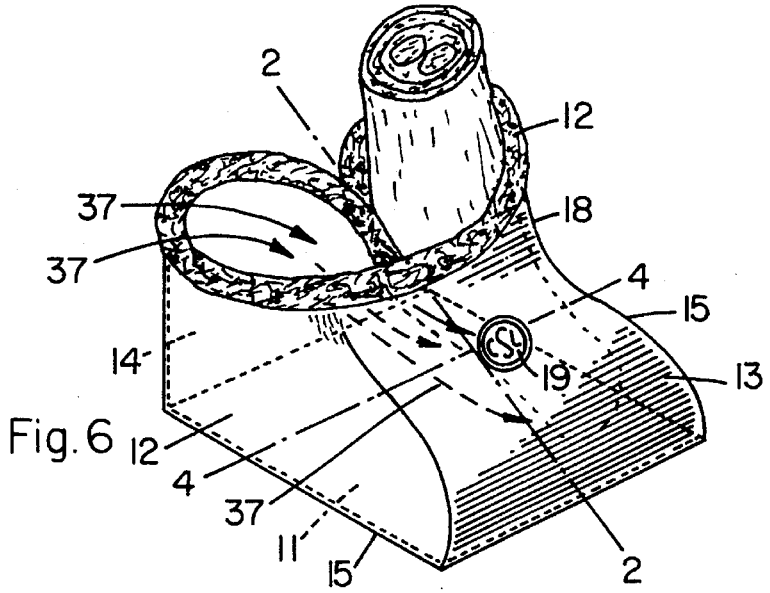
FIG. 6 is an isometric view of another foot muff of the prior art U.S. Pat. No. 1,608,188.
Figure 7:
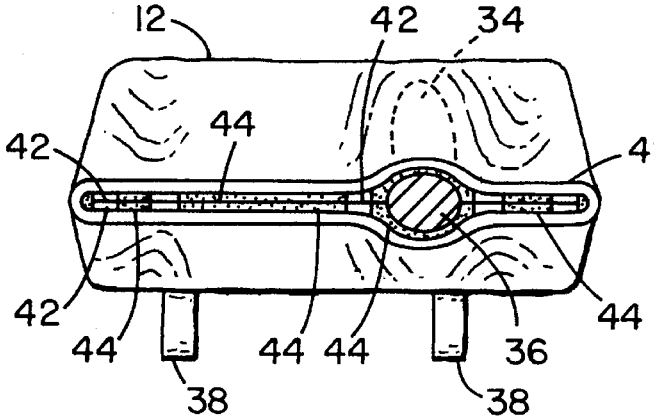
FIG. 7 is a comparative view to FIG. 5 and 6 of the present article wherein the user is a one legged person.

The insulating means can be DACRON holofil, polyester pile, goose down, or the like. The insulating level of the fill material can be adjusted by the manufacturer to provide various models of the present article for accommodating any indoor or outdoor environments or temperature conditions to be encountered by the consumer user. A preferred construction of the article comprises an exterior waterproof casing 46 of synthetic fabric material such as GORTEX, or Waterproof treated NYLON or other fabric, an interior barrier 48, preferably of heavy fabric material, and the insulating fill layer 44, e.g., felt-like material of cotton, wool, polyester, or the like secured therebetween. As shown in FIGS. 3 and 6, when the rim is snugged around a users legs or leg, it is preferred that the softer fill layer 44 lie against the legs or leg for both comfort and sealing. Preferably, casing 46 and barrier 48 are affixed, e.g., by adhesive to a semi-rigid, boot sole type of base means 20, on which an interior insulating pad 50 may be provided. This article, for one utility, is designed to be used in the stationary position as a foot and leg warmer and is large around the user's legs to readily accommodate sitting and standing activity.

It is preferred that exterior casing 46 be of sufficient strength and rigidity to support the article in substantially the free-standing posture shown in the drawing, however, the casing, as well as the other components of the article should be sufficiently flexible or pliant to allow the rim means to be easily sealed around the legs as shown in FIG. 3. It is particularly noted that the large dimensions of the pocket means as seen in FIGS. 2 and 3, of the protective article provides markedly improved utility in regard to the user being able to easily and comfortably stand up or sit down with his feet and legs within the article, i.e., he experiences no stumbling tendency due to lower leg or foot constraints.

Figure 2:
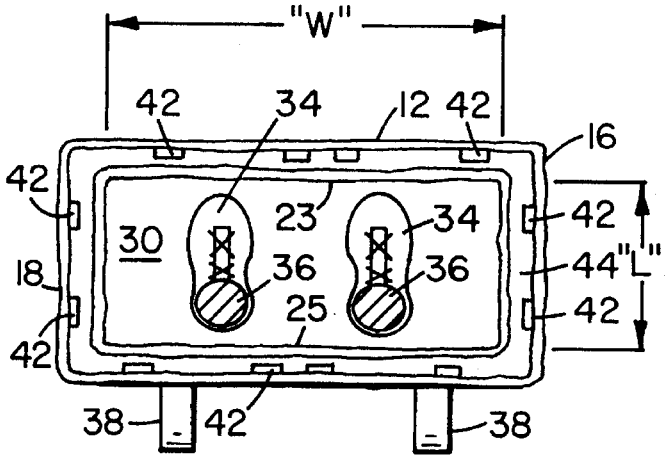
FIG. 2 is a top elevational view of the article showing one embodiment of the closure means.
Figure 4:
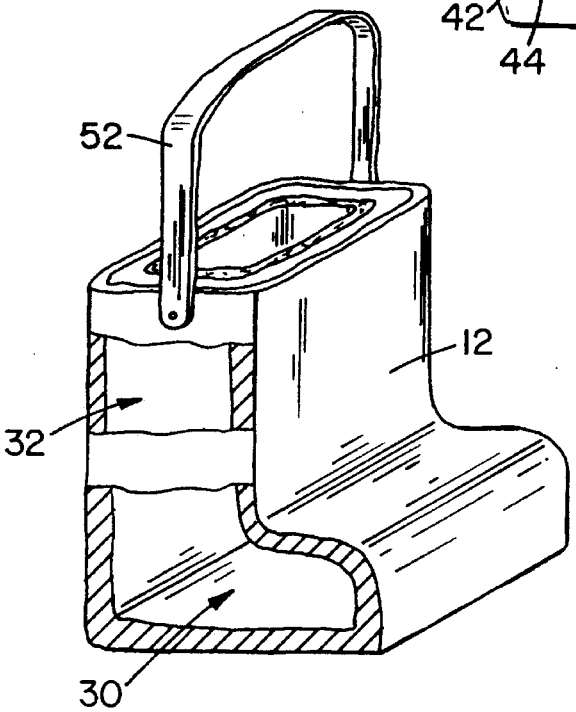
FIG. 4 is an isometric view with portions of the side broken away, of a generally boot-shaped variation of the article design provided with a handle strap for hand carrying.
Figure 5:
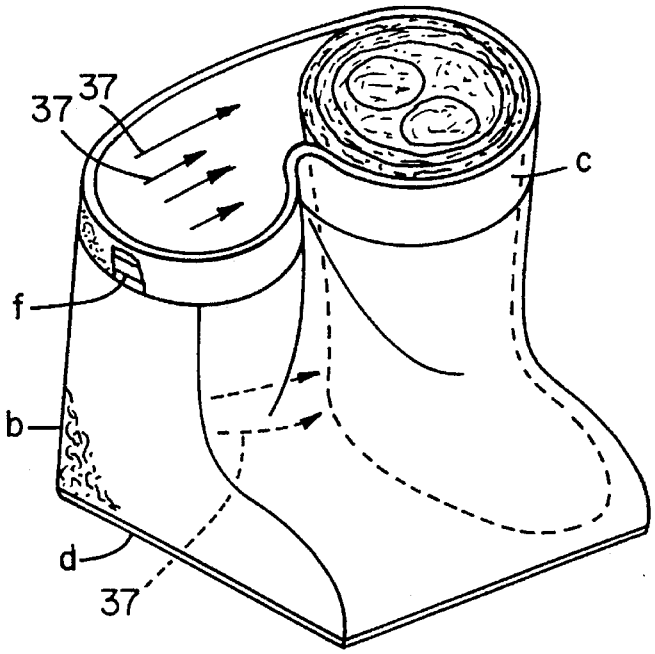
Fig. 5 PRIOR ART
FIG. 5 is an isometric view of a foot muff of the prior art U.S. Pat. No. 1,686,588.

The carrying means 38 in FIGS. 1, 2 and 3 is shown as a pair of knapsack type shoulder straps, which is the most preferred manner of carrying the article. A handle type strap such as 52 shown in FIG. 4 may also be used. The configuration and construction of the article provides an easily accessible entry for placing various items such as thermos bottles, food packages, beverage cans or bottles, event programs, articles of clothing, pre-game shopping items, or the like into and retrieving from the pocket means of the article.

The multifunctional aspect of the present article, as aforesaid, creates considerably more need for and desire to use it than is experienced with the single function body warming devices of the prior art.

The invention has been described in detail with particular reference to preferred embodiments thereof, but it will be understood that variations and modifications will be effected with the spirit and scope of the invention.

I claim:

1. A multipurpose protective article having both body warming and item toting capacities, said article comprising front means, back means, opposite side means, and base means, all of which are sealingly interconnected to form a generally bag-shaped body means providing pocket means therein, said body means having a top portion located above said base means and having a closeable opening therethrough entering into said pocket means, said body means being constructed of flexible thermal material and having flexible rim means extending around said top portion thereof and defining said closeable opening, said rim means further being easily enfoldable snugly around one or two spaced apart legs of a user extending into said pocket means to substantially close said opening therearound, said pocket means being sufficiently large to easily accommodate the users feet and legs at least up to about adjacent the knee and to readily provide for sitting and standing activity without restricting movement of the feet or lower legs which might otherwise cause stumbling or falling of the user, and cooperating elements of closure means on opposing portions of said rim means and being positioned and adapted for fastening engagement with each other for holding said opposing portions together to maintain a snug, substantially air-sealing fit of said rim means around each said leg to provide and maintain a substantially dead-air space in said pocket means to enhance the body heat trapping and containment efficiency of said article, said body means further having carrying means affixed to an exterior portion thereof for hand, arm or shoulder supporting of said article.

2. The article of claim 1 constructed of sufficiently rigid material to allow the article to freely stand on its base means with said rim means elevated above said base means substantially the length of a human lower leg.

3. The article of claim 1 wherein said closure means extends substantially the full length of said rim means whereby any portion of said rim means along its length can be left unclosed to accommodate the legs or leg of a user, whether the legs are positioned close together or spaced a substantial distance apart, and whereby the portions of said rim means contiguous said any portion can be snugly closed around said legs or leg.

4. The article of claim 1 wherein said flexible thermal material comprises spaced inner and outer containment layers and thermal insulating material supported therebetween.

5. The article of claim 4 wherein said base means is substantially flat and constructed of substantially rigid material, and said outer containment layer is sufficiently rigid to readily support said article in an upright, free-standing posture on said base means.

6. The article of claim 1 wherein said carrying means comprises a pair of back-pack type strap means adapted to extend outwardly from said body means and loop over both shoulders of the user.

7. The article of claim 1 wherein the exterior of said base means is constructed of waterproof semi-rigid material

8. The article of claim 1 wherein the exterior portion of said body means is constructed of substantially waterproof material.

9. The article of claim 8 wherein the exterior of said base means is constructed of waterproof, semi-rigid material.

10. The article of claim 1 wherein said body means is dimensioned to provide a foot containing area of said pocket means with a front to back length of from about 6 to about 15 inches, a side to side width of from about 11 to about 18 inches, and wherein the height of said pocket means is from about 12 to about 24 inches.

11. The article of claim 1 wherein said front, back, and opposite sides are normally spaced apart substantially a uniform distance along the full height thereof.

12. The article of claim 1 wherein said cooperating elements of said closure means are selected from the group consisting of (a) a plurality of plastic hooks and cooperating loops, (b) a plurality of cooperating snap fastener components, (c) a plurality of eyelets and at least one tie cord means therefor, (d) a plurality of cooperating buckle means and strap means, (e) one pair or a plurality of pairs of cooperating pealable adhesive components, (f) a plurality of cooperating buttons and button holes, and (g) a plurality of hooks and at least one tie cord therefor.

13. The article of claim 1 wherein said closure means comprises snap-fastener means.

14. The article of claim 1 wherein said closure means comprises one pair or a plurality of pairs of multitudinous plastic hook means and cooperating plastic loop means on opposing portions of said rim means.

15. The article of claim 14 wherein said closure means comprises one pair of said hook means and loop means positioned along substantially opposite halves of said rim means.

16. The article of claim 1 constructed of sufficiently rigid material to allow the article to freely stand on its base means with said rim means elevated above said base means substantially the length of a human lower leg, and wherein said closure means extends substantially the full length of said rim means such that any portion of said rim means along its length is adapted to be left unclosed in order to accommodate the legs or leg of a user, whether the legs are positioned close together or spaced a substantial distance apart, and such that the portions of said rim means contiguous said any portion can be snugly closed around said legs or leg.

17. The article of claim 16 wherein said body means is dimensioned to provide a foot containing area of said pocket means with a front to back length of from about 6 to about 15 inches, a side to side width of from about 11 to about 18 inches, and wherein the height of said pocket means is from about 12 to about 24 inches.

18. The article of claim 17 wherein said front, back, and opposite sides are normally spaced apart substantially a uniform distance along the full height thereof.

19. The article of claim 18 wherein said closure means is selected from the group consisting of (a) a plurality of hooks and cooperating loops, (b) a plurality of cooperating snap fastener components, (c) a plurality of eyelets and at least one tie cord means therefor, (d) a plurality of cooperating buckle means and strap means, (e) one pair or a plurality of pairs of cooperating adhesive components, (f) a plurality of cooperating buttons and button holes, and (g) a plurality of hook means and at least one tie cord therefor.

20. The article of claim 18 wherein said closure means comprises one pair or a plurality of pairs of multitudinous plastic hook means and cooperating plastic loop means on opposing portions of said rim means.

* * * * *